US007861949B1

(12) United States Patent
Rodriguez

(10) Patent No.: US 7,861,949 B1
(45) Date of Patent: Jan. 4, 2011

(54) PORTABLE WASHING APPARATUS

(76) Inventor: Jesus R. Rodriguez, 9619 Anderson Way, Converse, TX (US) 78109

( * ) Notice: Subject to any disclaimer, the term of this patent is extended or adjusted under 35 U.S.C. 154(b) by 237 days.

(21) Appl. No.: 12/142,199

(22) Filed: Jun. 19, 2008

(51) Int. Cl.
*A62C 13/62* (2006.01)
*B05B 15/06* (2006.01)

(52) U.S. Cl. ..... 239/304; 239/532

(58) Field of Classification Search ..... 239/302–305, 239/337, 373, 443, 444, 569, 349, 353, 149, 239/170, 532
See application file for complete search history.

(56) References Cited

U.S. PATENT DOCUMENTS 3,002,698 A 10/1961 Gallo
3,260,443 A 7/1966 Giovansanti et al.
D312,297 S 11/1990 Ballu
4,967,960 A 11/1990 Futrell
4,984,742 A 1/1991 Ellison et al.
5,072,884 A 12/1991 Ellison et al.
D327,528 S 6/1992 Sears et al.
5,775,591 A 7/1998 Fauci
6,158,673 A * 12/2000 Toetschinger et al. ..... 239/305
D485,037 S 1/2004 Presnell et al.

* cited by examiner

*Primary Examiner*—Davis Hwu

(57) ABSTRACT

A portable washing apparatus includes a housing that has a bottom wall, a top wall and a perimeter wall. A dividing wall divides the housing into a first compartment and a second compartment. A valve is mounted in the housing and is fluidly coupled to each of the first and second compartments. An outlet pipe is fluidly coupled to the valve. Actuation of the valve allows selective fluid communication between the outlet pipe and the first or second compartments. A pump is fluidly coupled to the outlet pipe and draws fluid out of the housing. A tube has a first end and a second end. The first end is fluidly coupled to the pump. Fluid drawn outwardly of the housing by the pump is ejected outwardly of the second end. A cleaning fluid is positioned in the first compartment and a rinsing fluid is positioned in the second compartment.

6 Claims, 5 Drawing Sheets

PORTABLE WASHING APPARATUS

BACKGROUND OF THE INVENTION

Field of the Invention

The present invention relates to portable washing devices and more particularly pertains to a new portable washing device for providing cleaning and rinsing fluids in a portable manner for a cleaning person.

SUMMARY OF THE INVENTION

The present invention meets the needs presented above by generally comprising a housing has a bottom wall, a top wall and a perimeter wall extending between the top and bottom walls. A dividing wall is positioned in the housing and divides the housing into a first compartment and a second compartment. A valve is mounted in the housing. The valve is fluidly coupled to each of the first and second compartments. An outlet pipe is fluidly coupled to the valve. Actuation of the valve allows selective fluid communication between the outlet pipe and the first or second compartments. The valve includes an actuator positioned on an outer surface of the perimeter wall. A pump is fluidly coupled to the outlet pipe and draws fluid out of the housing when the pump is actuated. A tube has a first end and a second end. The first end is fluidly coupled to the pump and the second end of the tube is positioned outside of the housing. Fluid drawn outwardly of the housing by the pump is ejected outwardly of the second end of the tube. A cleaning fluid is positioned in the first compartment and a rinsing fluid is positioned in the second compartment.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
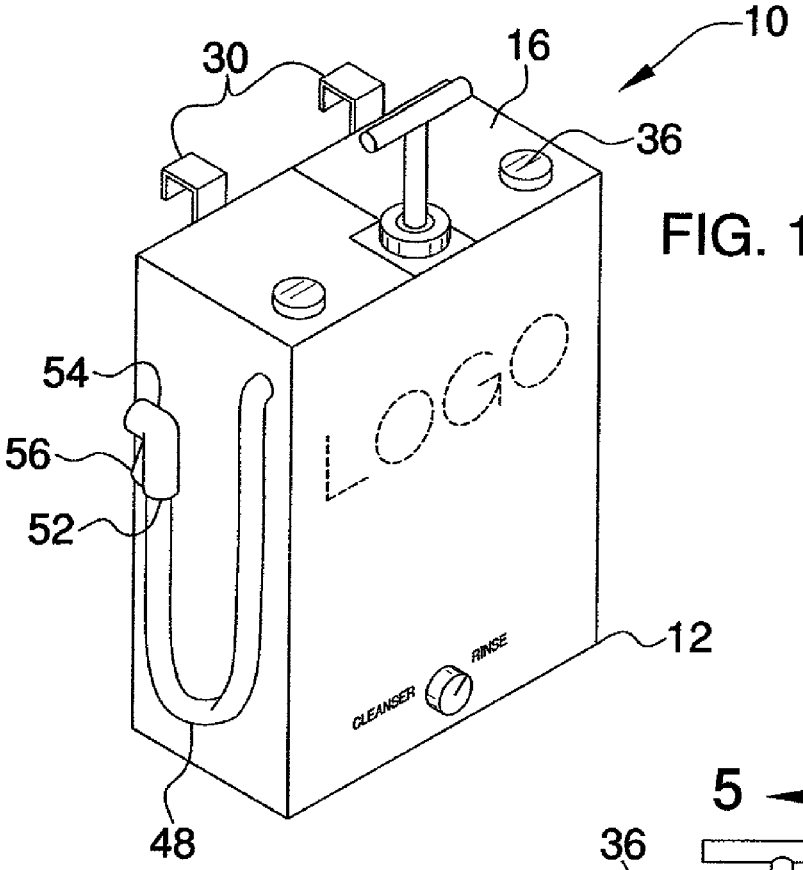
FIG. 1 is a front perspective view of a portable washing apparatus according to the present invention.
Figure 2:
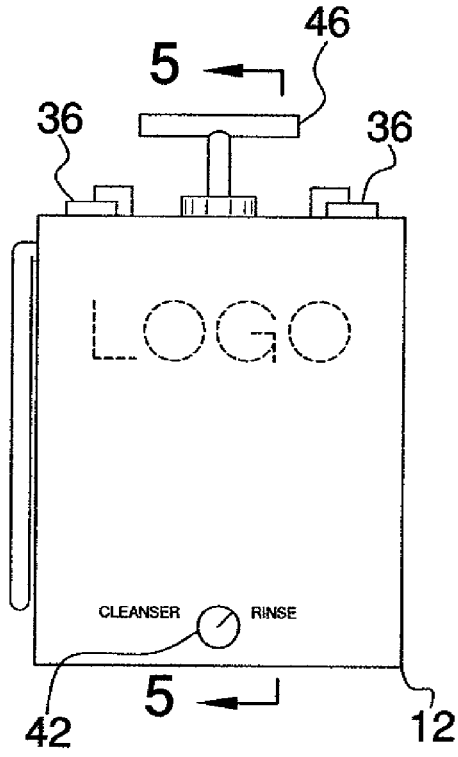
FIG. 2 is a front view of the present invention.
Figure 3:
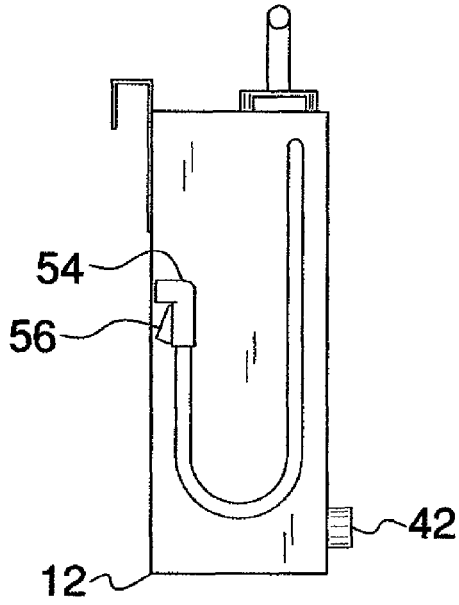
FIG. 3 is a side view of the present invention.
Figure 4:
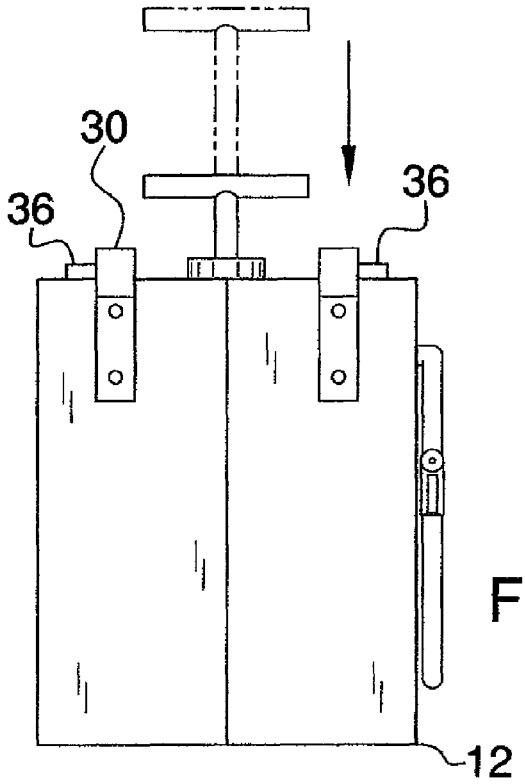
FIG. 4 is a rear view of the present invention.
Figure 5:
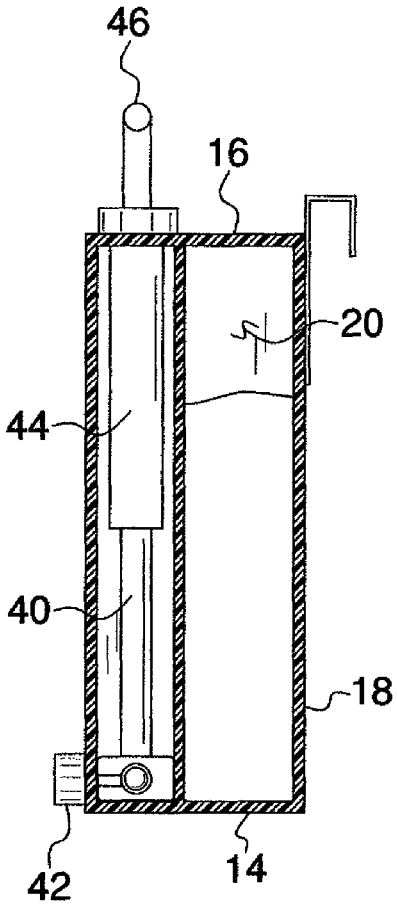
FIG. 5 is a cross-sectional view taken along line 5-5 of FIG. 2 of the present invention.
Figure 6:
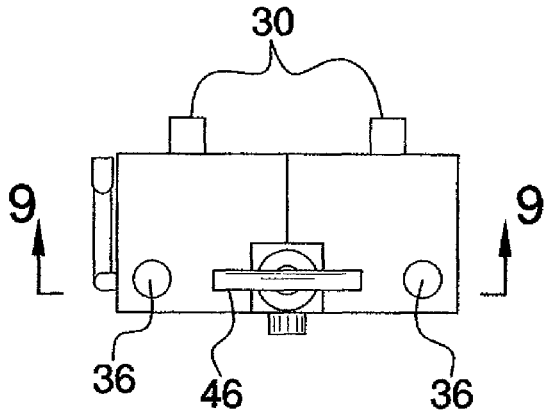
FIG. 6 is a top view of the present invention.
Figure 7:
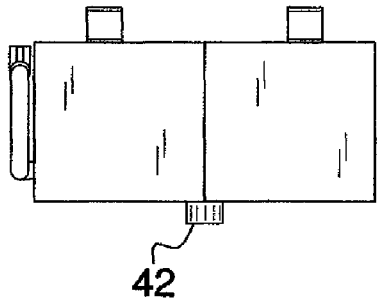
FIG. 7 is a bottom view of the present invention.
Figure 8:
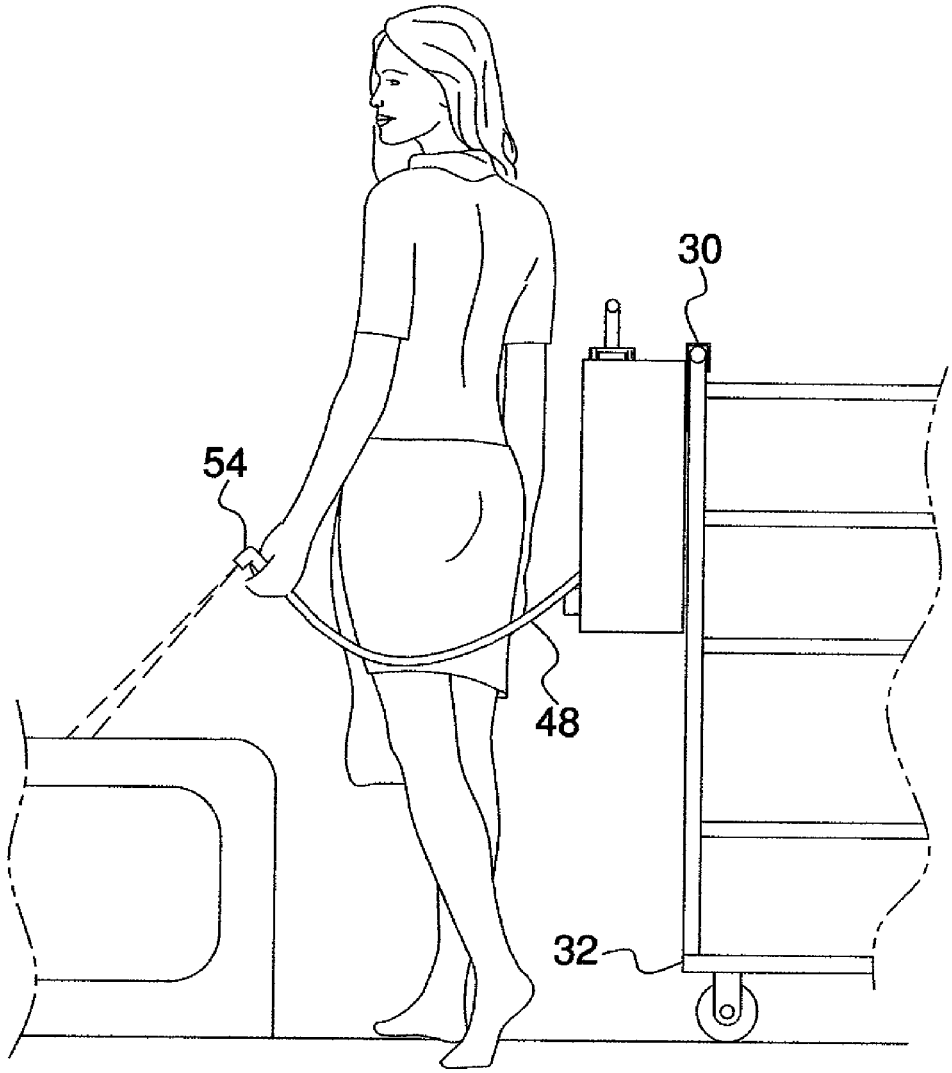
FIG. 8 is a side in-use view of the present invention.
Figure 9:
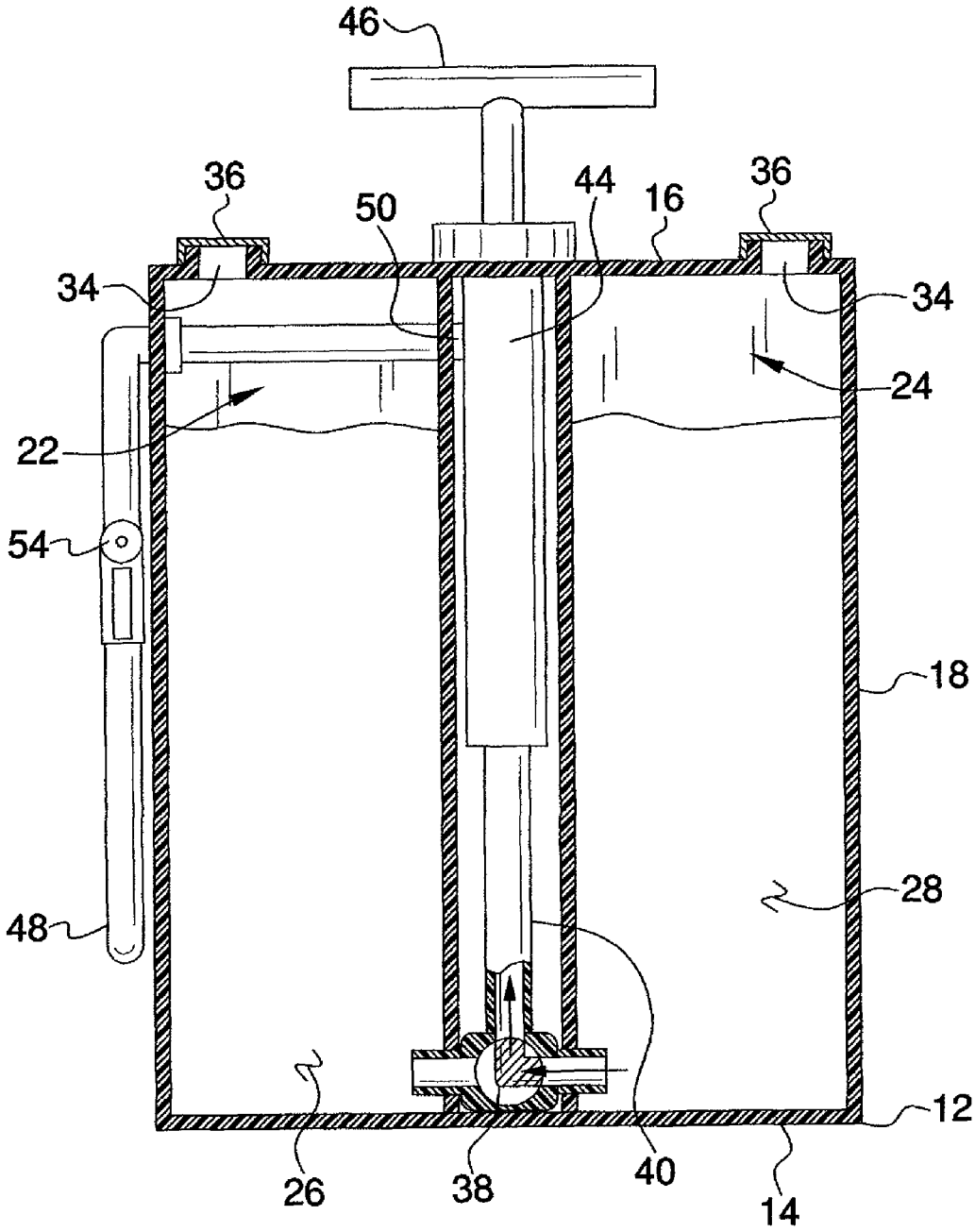
FIG. 9 is a cross-sectional view taken along line 9-9 of FIG. 6 of the present invention.

With reference now to the drawings, and in particular to FIGS. 1 through 9 thereof, a new portable washing device embodying the principles and concepts of the present invention and generally designated by the reference numeral 10 will be described.

As best illustrated in FIGS. 1 through 9, the portable washing apparatus 10 generally comprises a housing 12 that has a bottom wall 14, a top wall 16 and a perimeter wall 18 extending between the top 16 and bottom 14 walls. A dividing wall 20 is positioned in the housing 12 and divides the housing 12 into a first compartment 22 and a second compartment 24. A cleaning fluid 26 is positioned in the first compartment 22 and a rinsing fluid 28 is positioned in the second compartment 24. At least one hook member 30 is attached to the housing 12 to allow the housing 12 to be coupled to a cart 32. Each of the compartments 22, 24 has one of a pair of fill openings 34 fluidly coupled thereto and each of a pair of coverings 36 is removably positioned over one of the fill openings 34.

A valve 38 is mounted in the housing 12. The valve 38 is fluidly coupled to each of the first 22 and second 24 compartments. An outlet pipe 40 is fluidly coupled to the valve 38. Actuation of the valve 38 allows selective fluid communication between the outlet pipe 40 and the first 22 or second 24 compartments. The valve 38 includes an actuator 42 positioned on an outer surface of the perimeter wall 18.

A pump 44 is fluidly coupled to the outlet pipe 40. The pump 44 draws fluid out of the housing 12 when the pump 44 is actuated. The pump 44 includes an actuation handle 46 extending upwardly from the housing 12. The pump 44 is actuated when the actuation handle 46 is pushed toward the housing 12.

A tube 48 has a first end 50 and a second end 52. The first end 50 is fluidly coupled to the pump 44. The second end 52 of the tube 48 is positioned outside of the housing 12. Fluid drawn outwardly of the housing 12 by the pump 44 is ejected outwardly of the second end 52 of the tube 48.

A conventional nozzle 54 is mounted on the second end 52 of the tube 48. A trigger 56 is mechanically coupled to the nozzle 54. The fluid is ejected outwardly of the nozzle 54 when the trigger 56 is actuated.

In use, the housing 12 is mounted on a cleaning cart 30 and the nozzle 54 may be used to spray either the cleaning fluid 26 or the rinsing fluid 28 where needed. The housing 12 provides for easy finding and usage of cleaning materials when a cleaning person, such as at a hotel, cleans a bathroom.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable washing apparatus comprising:

a housing having a bottom wall, a top wall and a perimeter wall extending between said top and bottom walls, a dividing wall being positioned in said housing and dividing said housing into a first compartment and a second compartment;

a valve being mounted in said housing, said valve being fluidly coupled to each of said first and second compartments, an outlet pipe being fluidly coupled to said valve, actuation of said valve allowing selective fluid communication between said outlet pipe and said first or second compartments, said valve including an actuator positioned on an outer surface of said perimeter wall;

a pump being fluidly coupled to said outlet pipe, said pump drawing fluid out of said housing when said pump is actuated, said pump including an actuation handle extending upwardly from said housing, said pump being actuated when said pump actuator is pushed toward said housing;

a tube having a first end and a second end, said first end being fluidly coupled to said pump, said second end of said tube being positioned outside of said housing, wherein fluid drawn outwardly of said housing by said pump is ejected outwardly of said second end of said tube;

a cleaning fluid being positioned in said first compartment; and a rinsing fluid being positioned in said second compartment.

2. The apparatus according to claim 1, further including a nozzle being mounted on said second end of said tube, a trigger being mechanically coupled to said nozzle, the fluid being ejected outwardly of said nozzle when said trigger is actuated.

3. The apparatus according to claim 1, further including at least one hook member being attached to said housing to allow said housing to be coupled to a cart.

4. The apparatus according to claim 3, further including each of said compartments having one of a pair of fill openings fluidly coupled thereto, each of a pair of coverings being removably positioned over one of said fill openings.

5. The apparatus according to claim 1, further including each of said compartments having one of a pair of fill openings fluidly coupled thereto, each of a pair of coverings being removably positioned over one of said fill openings.

6. A portable washing apparatus comprising:

a housing having a bottom wall, a top wall and a perimeter wall extending between said top and bottom walls, a dividing wall being positioned in said housing and dividing said housing into a first compartment and a second compartment;

a valve being mounted in said housing, said valve being fluidly coupled to each of said first and second compartments, an outlet pipe being fluidly coupled to said valve, actuation of said valve allowing selective fluid communication between said outlet pipe and said first or second compartments, said valve including an actuator positioned on an outer surface of said perimeter wall;

a pump being fluidly coupled to said outlet pipe, said pump drawing fluid out of said housing when said pump is actuated, said pump including an actuation handle extending upwardly from said housing, said pump being actuated when said pump actuator is pushed toward said housing;

a tube having a first end and a second end, said first end being fluidly coupled to said pump, said second end of said tube being positioned outside of said housing, wherein fluid drawn outwardly of said housing by said pump is ejected outwardly of said second end of said tube;

a nozzle being mounted on said second end of said tube, a trigger being mechanically coupled to said nozzle, the fluid being ejected outwardly of said nozzle when said trigger is actuated;

a cleaning fluid being positioned in said first compartment;

a rinsing fluid being positioned in said second compartment;

at least one hook member being attached to said housing to allow said housing to be coupled to a cart; and each of said compartments having one of a pair of fill openings fluidly coupled thereto, each of a pair of coverings being removably positioned over one of said fill openings.

* * * * *